US010293351B2

(12) United States Patent
Krayer

(10) Patent No.: US 10,293,351 B2
(45) Date of Patent: May 21, 2019

(54) PAINT SPRAYING APPARATUS

(71) Applicant: J. WAGNER GMBH, Markdorf (DE)

(72) Inventor: Elmar Krayer, Langenargen (DE)

(73) Assignee: J. Wagner GmbH, Markdorf (DE)

( * ) Notice: Subject to any disclaimer, the term of this patent is extended or adjusted under 35 U.S.C. 154(b) by 0 days.

(21) Appl. No.: 15/493,511

(22) Filed: Apr. 21, 2017

(65) Prior Publication Data

US 2017/0304853 A1 Oct. 26, 2017

(30) Foreign Application Priority Data

Apr. 22, 2016 (DE) ..... 10 2016 107 465

(51) Int. Cl.

| | |
|---|---|
| ***B05B 7/24*** | (2006.01) |
| ***B05B 15/62*** | (2018.01) |
| *B05B 7/00* | (2006.01) |
| *B05B 15/63* | (2018.01) |

(52) U.S. Cl.

CPC ..... *B05B 7/2408* (2013.01); *B05B 7/2416* (2013.01); *B05B 7/2467* (2013.01); *B05B 15/62* (2018.02); *B05B 7/0081* (2013.01); *B05B 15/63* (2018.02)

(58) Field of Classification Search

CPC ... B05B 7/2408; B05B 7/2467; B05B 7/2416; B05B 15/62; B05B 15/63; B05B 7/0081

USPC ..... 239/375

See application file for complete search history.

(56) References Cited

U.S. PATENT DOCUMENTS

| | | | | |
|---|---|---|---|---|
| 7,360,720 | B2 * | 4/2008 | Gohring | B05B 7/2416 118/300 |
| 7,374,377 | B2 * | 5/2008 | Bauman | B23B 31/008 279/143 |
| 7,431,223 | B2 * | 10/2008 | Gohring | B05B 7/2402 239/296 |
| 7,484,676 | B2 * | 2/2009 | Joseph | B05B 7/2435 239/290 |
| 7,540,434 | B2 * | 6/2009 | Gohring | B05B 7/0815 239/290 |
| 7,549,449 | B2 * | 6/2009 | Herre | B05B 5/1616 141/104 |
| 7,694,896 | B2 * | 4/2010 | Turnbull | B05B 7/2478 239/11 |
| 8,628,029 | B2 * | 1/2014 | Munn | B05B 7/0815 239/290 |

FOREIGN PATENT DOCUMENTS

DE 20 2005 005 054 U1 9/2006

* cited by examiner

*Primary Examiner* — Chee-Chong Lee
(74) *Attorney, Agent, or Firm* — Burr & Brown, PLLC

(57) ABSTRACT

The present invention relates to a paint spraying apparatus including a housing, a spray head, and a paint container, with a handle, a first receptacle space for a blower, and a second receptacle space for an air filter are formed by the housing. The housing includes a central housing part having a first housing portion and a second housing portion and a rear housing part. The first housing portion is configured so as to be shell-shaped and open toward the rear housing part, with the second housing portion projecting radially from the first housing portion, such that the first housing portion of the central housing part forms a first part of the first receptacle space, and a shell-shaped first housing portion, open toward the central housing part, of the rear housing part forms a second part of the first receptacle space.

18 Claims, 4 Drawing Sheets

PAINT SPRAYING APPARATUS

This application claims the benefit under 35 USC § 119(a)-(d) of German Application No. 10 2016 107 465.9 filed Apr. 22, 2016, the entirety of which is incorporated herein by reference.

FIELD OF THE INVENTION

The present invention relates to a paint spraying apparatus.

BACKGROUND OF THE INVENTION

A paint spraying apparatus which comprises a housing, a spray head, and a paint container is known from DE 20 2005 005 054 U1, wherein a handle, a first receptacle space for a blower, and a second receptacle space for an air filter are formed by the housing.

SUMMARY OF THE INVENTION

The present invention is based on the object of developing a paint spraying apparatus in the case of which a housing that is assembled from a plurality of housing parts, despite having a light weight, has high inherent stability and high density, and is producible in a cost-effective manner.

In the case of the paint spraying apparatus according to the present invention, the housing comprises a central housing part and a rear housing part, wherein the central housing part comprises a first housing portion and a second housing portion, wherein the first housing portion is configured so as to be shell-shaped and open toward the rear housing part, wherein the second housing part in relation to a longitudinal axis that is defined by a motor shaft of the blower that is received in the first housing portion projects radially from the first housing portion, wherein the first housing portion of the central housing part forms a first part of the first receptacle space, and wherein a shell-shaped first housing portion, open toward the central housing part, forms a second part of the first receptacle space. In the case of a paint spraying apparatus having a housing with housing parts that are designed so as to be shell-shaped a weight that is lighter in comparison to housings of clamshell construction can be achieved, since the housing parts that are configured so as to be shell-shaped, caused by the geometry thereof, have higher inherent stability such that the wall thickness of the housing parts can be implemented so as to be thinner as stability is maintained or even increased. A spray painting apparatus of this type, by virtue of the lower material requirement, can be produced in a more cost-effective manner. Moreover, the shell-shaped housing parts can be sealed in relation to one another more easily than clamshells. Enhanced tightness is demonstrated, in particular, in the case of stress of the paint spraying apparatus by laterally applied pressure, since the latter, by contrast to housings from clamshells, leads to a significantly diminished degree of gap formation between the shell-shaped housing parts. Furthermore, a housing based on a shell-type construction can be built from a multiplicity of small housing parts or injection-molded parts, respectively, and can, thus, be produced in a simple and cost-effective manner. Finally, a transition that is capable of absorbing stress is ensured by the configuration of a handle on a shell-shaped housing part.

A shell-shaped configuration of housing parts in the context of the invention is to be understood as an imparted shaping in which the housing part has an encircling wall and an annular or circular base. In particular, all housing parts are embodied as plastic components that are produced by the injection molding method.

It is provided that the radially projecting second housing portion of the central housing part is configured as a tubular closed housing portion. On account thereof, the handle is imparted high flexural and torsional rigidity such that even comparatively heavy paint spraying apparatuses, that is to say paint spraying apparatuses having a powerful motor and/or a large capacity of the paint container can be safely guided by the handle.

It is also provided that the radially projecting housing portion is configured as shell-shaped housing portion that is open in the spraying direction of the paint spraying apparatus, and to form a first part of the handle by way of the radially projecting housing portion. On account thereof, an interior space of the handle is readily accessible during assembly such that electrical and electronic equipment of the paint spraying apparatus can be readily installed in the handle.

It is furthermore provided that the paint spraying apparatus comprises a front housing part, and that the front housing part is configured so as to be shell-shaped and open toward the central housing part. On account thereof, the housing can readily be further stabilized and shaped in terms of design.

In the case of a shell-shaped configuration of the first part of the handle, it is provided that the front housing part also forms a second part of the handle, and together with the first part of the handle forms a tubular handle. In this way, the first part of the handle is stabilized by the second part of the handle, and the dual-shell handle is lined to the further housing parts in an optimal manner.

It is also provided that the paint spraying apparatus is equipped with an end cap by way of which the end side of the handle at the free end thereof is closable. Further stabilizing of the handle is performed on account thereof.

It is furthermore provided that the first receptacle space is closed by the rear housing part. On account thereof, the first receptacle space which receives the blower is stabilized in an optimal manner, and the blower is held in a secure manner and is well sealed.

It is provided that a shell-shaped open second housing portion which forms the second receptacle space is configured on the rear housing part, so as to be opposite the first receptacle space, wherein an encircling side wall of the second receptacle space is formed in particular by a ring that is connected to the rear housing part. On account thereof, the housing has a second receptacle space in which the air filter can be reliably received.

It is also provided that the housing comprises a housing lid by way of which the second receptacle space is closed, wherein the housing lid encompasses the rear housing part in particular into the region of the first receptacle space. Closing the second receptacle space by a housing lid allows the air filter to be changed by simply removing the housing lid.

It is furthermore provided that all directly neighboring housing parts in the assembled state are interconnected so as to be secured against rotation and/or displacement, wherein the directly neighboring housing parts in the assembled state are interconnected, in particular, in a materially integral manner and/or having an interdiposed annular seal. On account thereof, tightness and stability of the housing are achieved in particular.

It is also provided that the paint spraying apparatus comprises a housing extension, wherein the housing extension is articulated on the handle so as to be pivotable or displaceable, wherein the handle is extended in an outwardly pivoted position or an outwardly displaced position, respectively, of the housing extension. On account thereof, the paint spraying apparatus has compact packing dimensions and/or can be adapted to paint containers of various heights such that the paint spraying apparatus in the case of paint containers of various heights always has a secure footing in which the paint spraying apparatus is supported by way of the paint container and the handle.

It is also provided that one of the housing parts or two neighboring housing parts forms/form a closable receptacle space for a battery pack. On account thereof, a battery pack can be accommodated so as to be protected from environmental influences.

It is furthermore provided that contacts for establishing contact to a battery pack and/or to a connector cable are disposed on one of the housing parts or on two neighboring housing parts. On account thereof, the contacts are coupled to the housing in a stable manner such that even heavy battery packs can be connected to the housing in a reliable manner.

It is furthermore provided that an adapter for connecting a spray head is formed by the housing, wherein the adapter is formed, in particular, by the central housing part and/or the front housing part. Reliable coupling of the blower to the housing is guaranteed on account thereof.

It is finally provided that the central housing part and/or the front housing part and/or the rear housing part and/or the housing lid in each case is/are configured as an integral shell-type component that is free of longitudinal joints. High inherent stability of the individual components and of the entire housing is achieved by a design of this type.

BRIEF DESCRIPTION OF THE DRAWINGS

Further details of the present invention will be described in the drawing by means of two exemplary embodiments that are illustrated in a partially schematic manner.

DETAILED DESCRIPTION OF THE INVENTION

Figure 1:
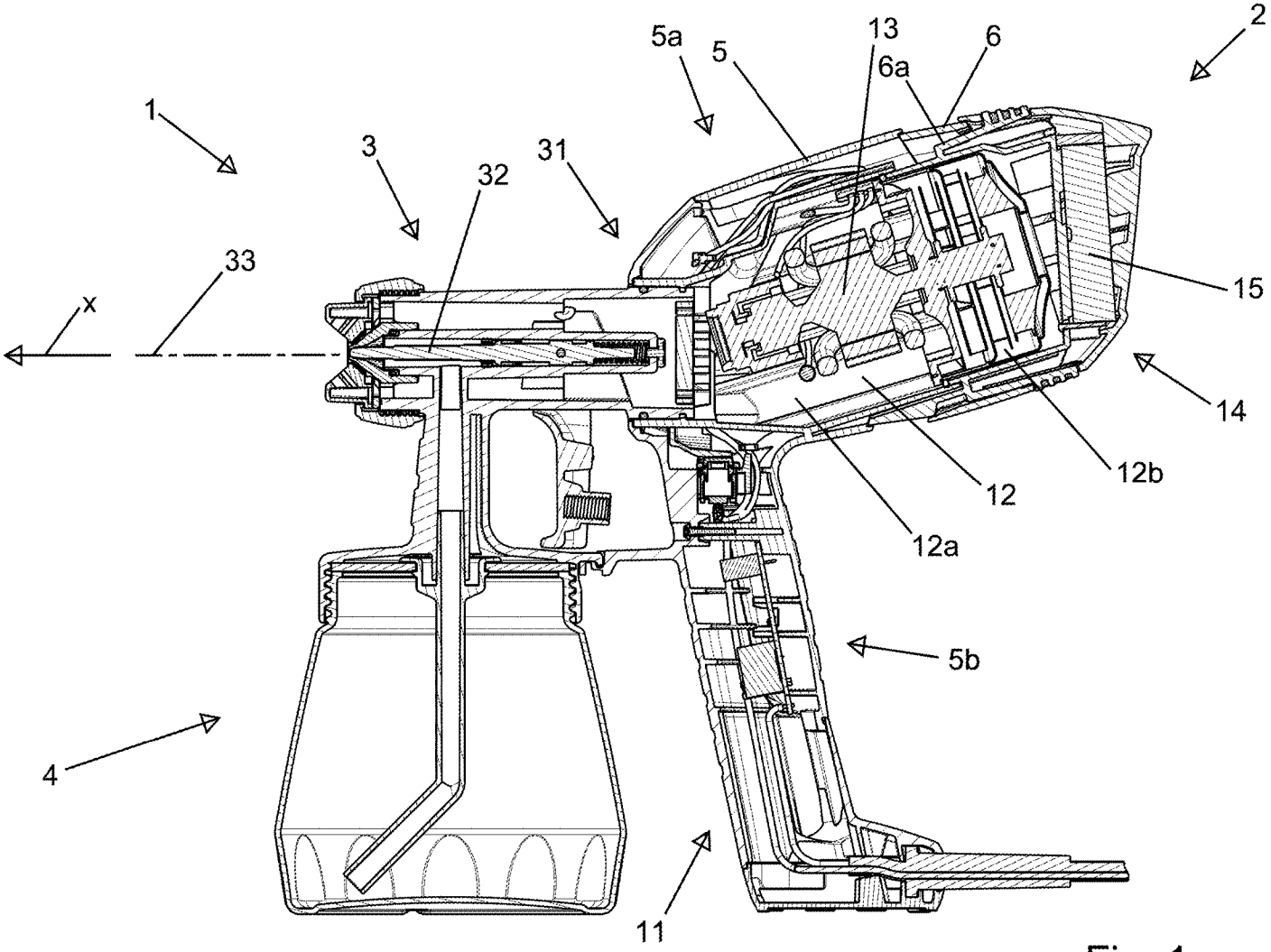
FIG. 1 shows a sectional side view of a paint spraying apparatus according to the invention.

A paint spraying apparatus 1 is shown in a sectional side view in FIG. 1. The paint spraying apparatus 1 is configured as a HVLP paint spraying apparatus. The paint spraying apparatus 1 comprises a housing 2, a spray head 3, and a paint container 4.

Figure 2:
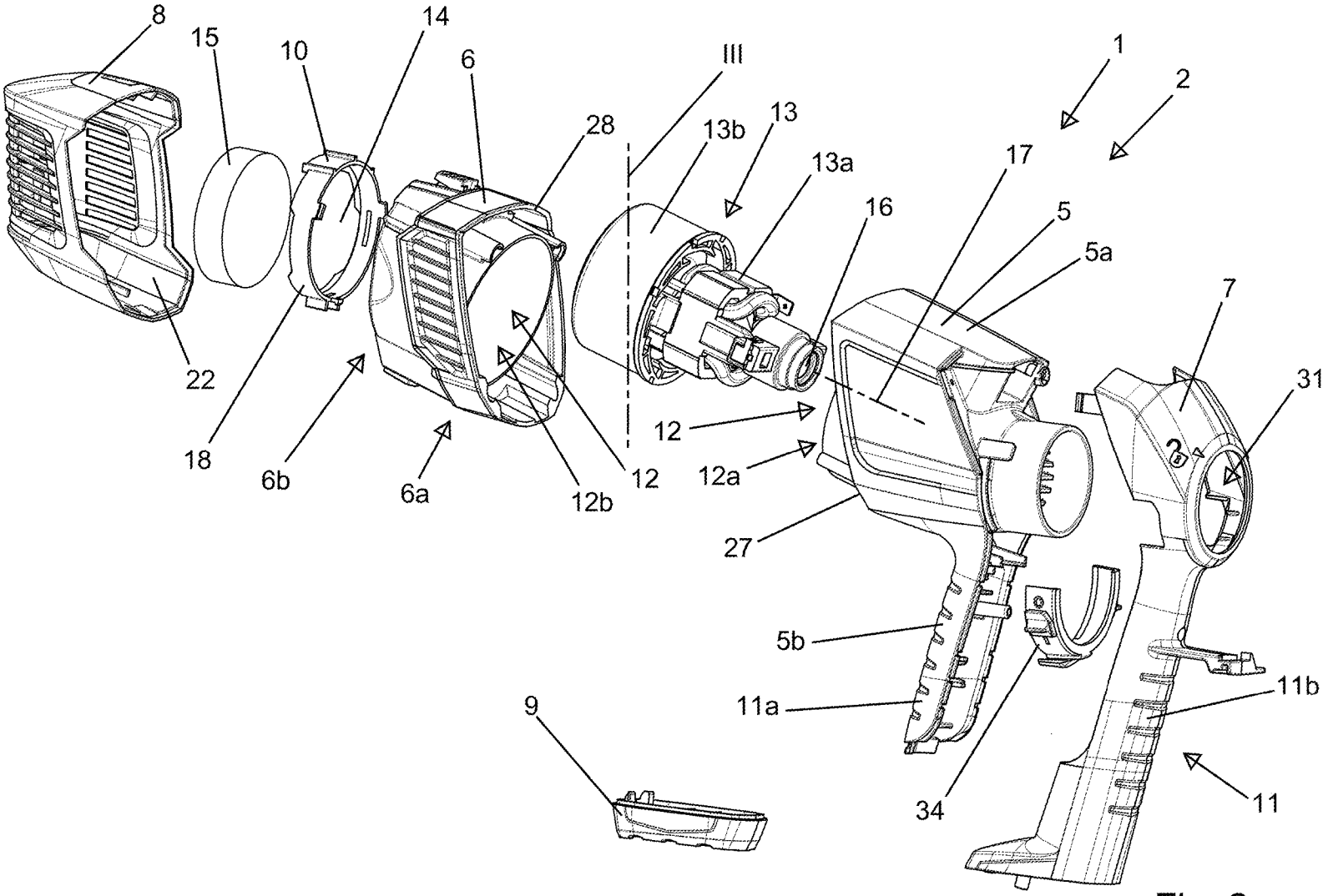
FIG. 2 shows a perspective exploded view of the housing parts of the paint spraying apparatus shown in FIG. 1.
Figure 3:
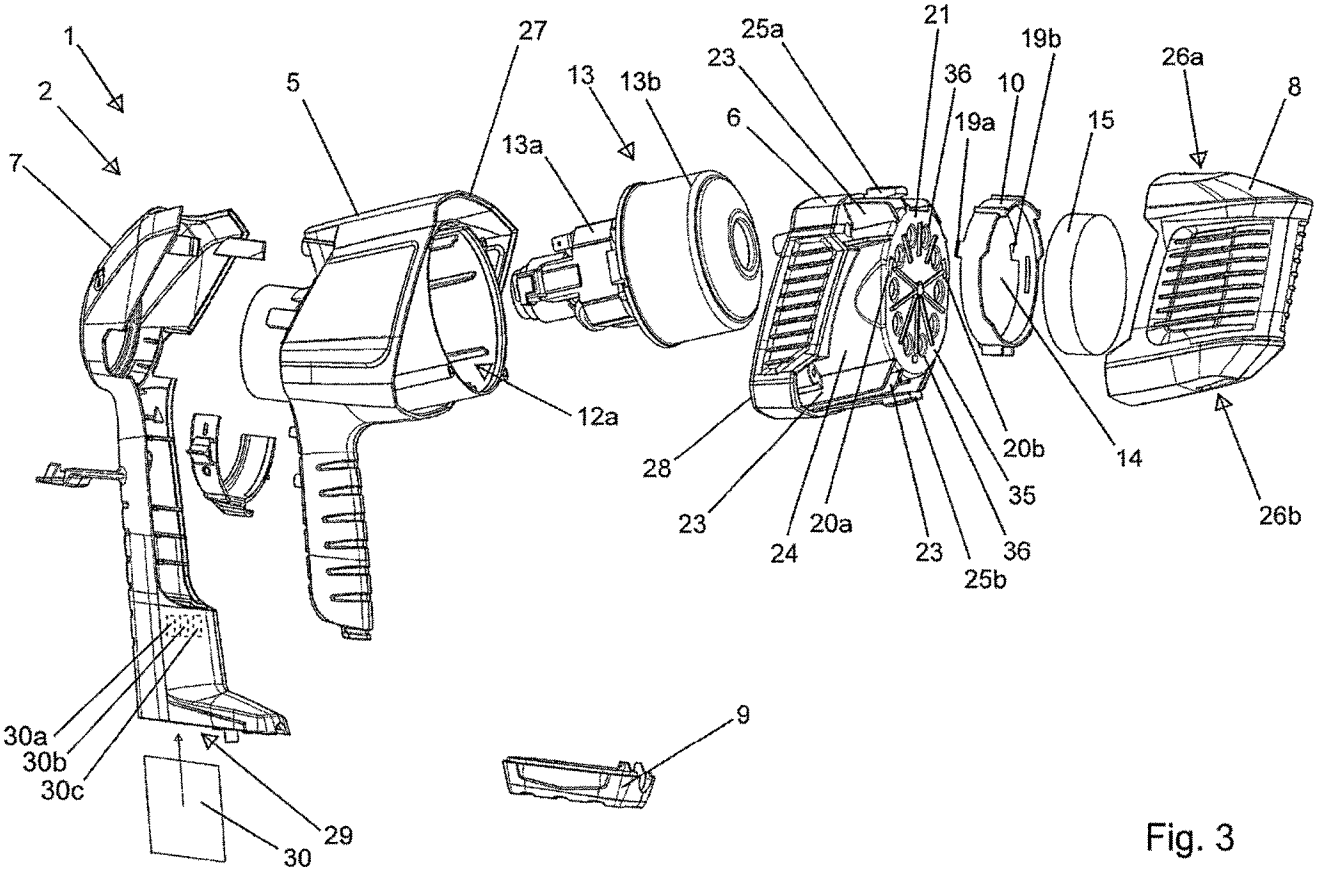
FIG. 3 shows a view of the exploded view shown in FIG. 2, rotated by 180° about the horizontal axis III.

The housing 2 which is illustrated together with further components of the paint spraying apparatus 1 in an exploded view from two different perspectives in FIGS. 2 and 3, comprises a central housing part 5, a rear housing part 6, a front housing part 7, a housing lid 8, an end cap 9, and a ring 10.

A handle 11 is formed by the housing 2, or by the central housing part 5 and the front housing part 7, respectively. Furthermore, a first receptacle space 12 for a blower 13 is formed by the housing 2, or by the central housing part 5 and the rear housing part 6, respectively. The blower 13 herein comprises an electric motor 13*a* and a radial compressor 13*b*. Finally, a second receptacle space 14 for an air filter 15 is formed by the housing 2, or by the rear housing part 6, the ring 10, and the housing lid 8.

The central housing part 5 comprises a first housing portion 5*a* and a second housing portion 5*b*. The first housing portion 5*a* is configured so as to be shell-shaped and to open toward the rear housing part 6 and toward the front housing part 7. The second housing portion 5*b* in relation to a longitudinal axis 17 that is defined by a motor shaft 16 of the blower 13 that is received in the first housing portion 5*a* projects radially from the first housing portion 5*a*, and forms a first part 11*a* of the handle 11. A second part 11*b* of the handle 11 is formed by the front house part 7. The dual-shell tubular handle 11 at the end side is closed by the end cap 9.

The first housing portion 5*a* of the central housing part forms a first part 12*a* of the first receptacle space 12, and a shell-shaped first housing portion 6*a*, open to the central housing part 5, of the rear housing part 6 forms a second part 12*b* of the first receptacle space 12. The rear housing part 6 thus closes the first receptacle space 12. The radial compressor 13*b* of the blower 13 herein is received in the second part 12*b* of the first receptacle space 12, and the electric motor 13*a* of the blower 13 is received in the first part 12*a* of the first receptacle space 12.

A shell-shaped open second housing portion 6*b* which forms the second receptacle space 14 is configured on the rear housing part 6, so as to be opposite the first receptacle space 12, wherein the encircling side wall 18 of the second receptacle space 14 is formed by the ring 10 that is connected to the rear housing part 6. The ring 10, by way of the tabs 19*a*, 19*b* thereof which engage in clearances 20*a*, 20*b* of a base 21 of the rear housing part 6, is connected to the latter (see FIG. 3). The second receptacle space 14 is closed by the housing lid 8. The housing lid 8 encompasses the rear housing part 6 in such a manner that the latter by way of the internal wall 22 thereof bears on ribs 23 which are disposed in a star-shaped manner on an external wall 24 of the housing part 6. The housing lid 8 herein is connected to the rear housing part 6 in a latching manner. To this end, the rear housing part 6 has two latching tabs 25*a*, 25*b* which in the assembled state engage in two clearances 26*a*, 26*b* of the housing lid 8. According to one variant of embodiment (not illustrated), it is also provided that the ring 10 and the rear housing part 6 are configured as one integral component. As is shown in FIG. 3, the rear housing part 6 also comprises a silencer 35. A multiplicity of openings 36 of the silencer 35, which are referenced only in an exemplary manner, are visible. The openings 36 in the assembled state of the paint spraying apparatus 1 are obscured by the air filter 15 that is received in the ring 10.

The central housing part 5 and the rear housing part 6, by way of an encircling periphery 27 of the first housing portion 5*a* and of an encircling periphery 28 of the first housing portion 6*a*, are mutually adapted such that the peripheries 27, 28 mutually engage in a tongue-and-groove-like form-fitting manner, the two housing parts 5, 6 in the assembled state thus stabilizing one another. According to one variant of embodiment (not illustrated), it is provided that an annular seal is disposed between the housing parts 6 and 7. A transmission of vibrations is reduced on account thereof, and good sealing of the first receptacle space 12 in relation to the environment is achieved on account thereof.

According to one variant of embodiment (not illustrated), it is provided that the paint spraying apparatus 1 is equipped with a housing extension. The housing extension herein is articulated on the handle 11 so as to be pivotable or displaceable, wherein the handle 11 is extended in an outwardly pivoted or outwardly extended position, respectively, of the housing extension. Alternatively, it is also provided that an adaptation of a length of the handle to a height of the paint container 4 is performed in that an installed end cap having a first height is replaced by an end cap having a second height. To this extent, it is provided that the paint spraying apparatus comprises at least two end caps which are installed depending on the paint container being used.

The front housing part 7 forms a receptacle space 29 for a battery pack 30. This receptacle space 29 is closable by the end cap 9. Contacts 30*a*, 30*b*. 30*c* shown in FIG. 3 are disposed in the handle 11, wherein the contacts are connected to the front housing part 7, the battery pack 30 being electrically contacted when fully inserted.

An adapter 31 for connecting the spray head 3 is formed by the housing 2, or by the central housing part 5 and the front housing part 7, respectively. The spray head 3 and the housing 2 can be coupled or separated, respectively, by rotating the spray head 3 and the housing 2 relative to one another about a longitudinal axis 33 that is defined by a nozzle needle 32. A set collar 34 is received between the central housing part 5 and the front housing part 7, so as to be rotatable about the longitudinal axis 33. An electric switch (not illustrated) by way of which the electric motor 13*a* can be switched on and off is activatable by rotating the set collar 34. A spraying direction x in which paint (not illustrated) is discharged from the paint spraying apparatus 1 is defined by the longitudinal axis 33 of the nozzle needle 32.

Figure 4:
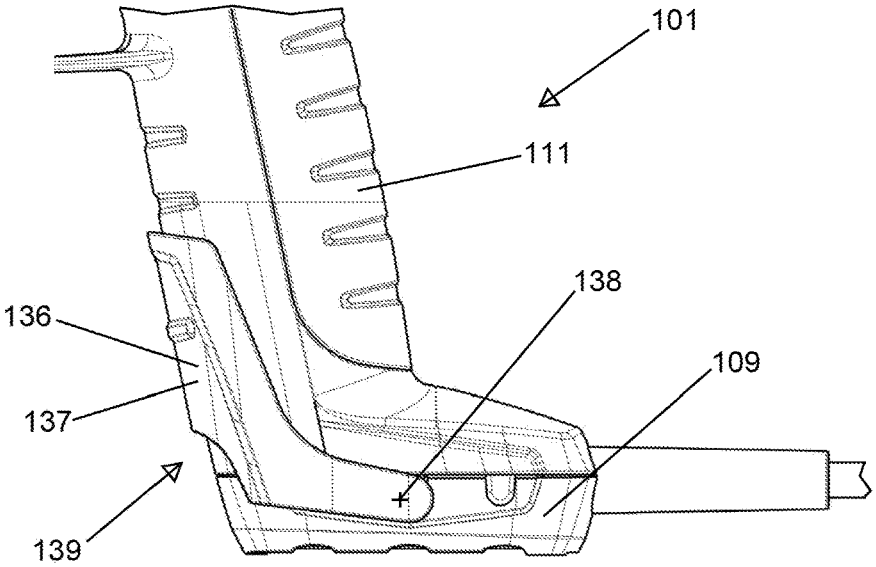
FIG. 4 shows a handle of a second variant of embodiment of a paint spraying apparatus according to the present invention, having a retracted housing extension.
Figure 5:
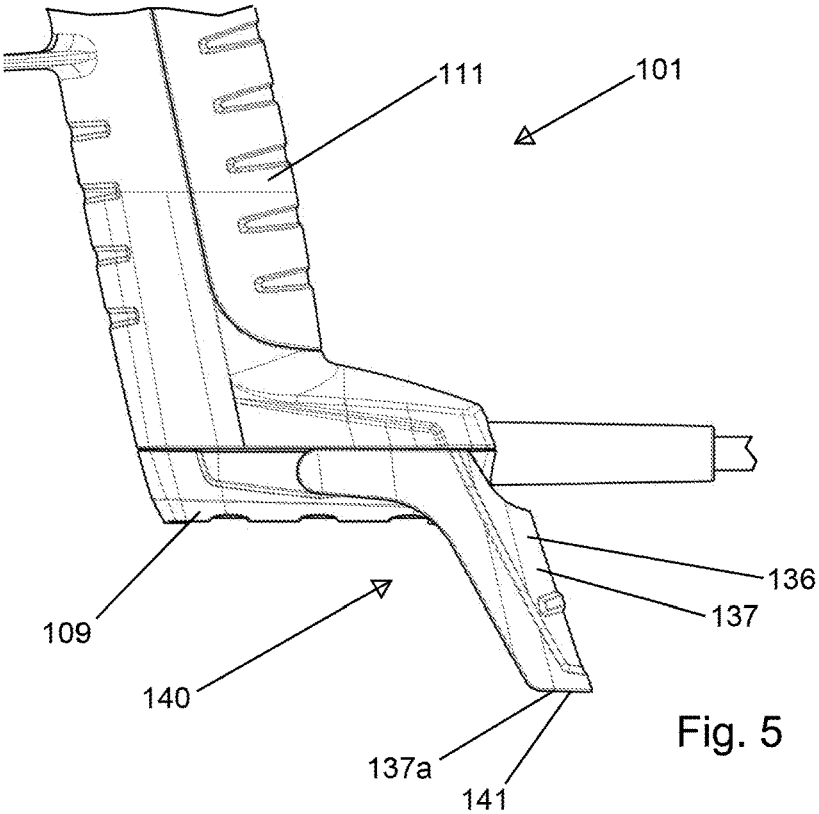
FIG. 5 shows the handle shown in FIG. 4, having a deployed housing extension.

A handle 111 of a second paint spraying apparatus 101 is shown in a side view in FIGS. 4 and 5. An end cap 109 of the handle 111 comprises a housing extension 136 which is embodied as a pivotable support 137. The support 137 is pivotable by approximately 180° about a pivot axis 138 that protrudes perpendicularly into the drawing plane from a first pivoted position 139, shown in FIG. 4, to a second pivoted position 140, shown in FIG. 5. The support 137 herein is fixed in a latching manner in both pivoted positions 139, 140 such that said support is securely held in place both in the pivoted position 139 as well as in the pivoted position 140. A free end 137*a* of the support 137 in the outwardly pivoted position 140 forms a base area 141 on which the paint spraying apparatus 101 in the set-down state is supported on a surface. The paint spraying apparatus 101 in the inwardly pivoted position 139 is adapted to the use of a low-profile paint container. The paint spraying apparatus 101 in the outwardly pivoted position 140 is adapted to the use of a high-profile paint container.

LIST OF REFERENCE SIGNS

1 Paint spraying apparatus
2 Housing
3 Spray head
4 Paint container
5 Central housing part
5*a* First housing portion of 5
5*b* Second housing portion of 5
6 Rear housing part
6*a* First housing portion of 6
6*b* Second housing portion of 6
7 Front housing part
8 Housing lid
9 End cap
10 Ring
11 Handle
11*a* First part of 11
11*b* Second part of 11
12 First receptacle space
12*a* First part of 12
12*b* Second part of 12
13 Blower
13*a* Electric motor
13*b* Radial compressor
14 Second receptacle space
15 Air filter
16 Motor shaft
17 Longitudinal axis
18 Side wall
19*a*, 19*b* Tab of 10
20*a*, 20*b* Clearance in 21 of 6
21 Base of 6
22 Internal wall of 8
23 Rib on 6
24 External wall of 6
25*a*, 25*b* Latching tabs on 6
26*a*, 26*b* Clearances on 9
27 Encircling periphery of 5*a*
28 Encircling periphery of 6*a*
29 Receptacle space for 27
30 Battery pack
31 Adapter
32 Nozzle needle
33 Longitudinal axis of 29
34 Set collar
35 Silencer
35*a* Opening of 35
101 Paint spray head
109 End cap
111 Handle
136 Housing extension
137 Pivotable support
137*a* Free end of 137
138 Pivot axis of 137
139 First pivoted position of 137
140 Second pivoted position of 137
141 Base area of 137
X Spraying direction
III Vertical axis

The invention claimed is:

1. A paint spraying apparatus comprising:
a housing;
a spray head; and
a paint container;
wherein the housing includes a handle, a first receptacle space for a blower, and a second receptacle space for an air filter;
wherein the housing comprises a front housing part, a central housing part and a rear housing part;
wherein the central housing part comprises a first housing portion and a second housing portion,
wherein the first housing portion of the central housing part has a configuration including an annular base and an encircling wall and is open toward the rear housing part,
wherein the second housing portion of the central housing part, relative to a longitudinal axis that is defined by a motor shaft of the blower that is received in the first housing portion, projects radially from the first housing portion, and wherein the first housing portion of the central housing part forms a first part of the first receptacle space;

wherein a first housing portion of the rear housing part, which has a configuration including an annular base and an encircling wall and which is open toward the central housing part, forms a second part of the first receptacle space;

wherein the front housing part has a configuration including an annular base and an encircling wall which is open toward the central housing part; and wherein at least one of the central housing part, the front housing part, and the rear housing part is configured as an integral component having an annular base and an encircling wall that is free of longitudinal joints in a longitudinal direction of the respective housing parts.

2. The paint spraying apparatus according to claim 1, wherein the radially projecting second housing portion of the central housing part is configured as a tubular closed housing portion.

3. The spraying apparatus according to claim 1, wherein the radially projecting second housing portion of the central housing part defines a housing portion having a configuration including an annular base and an encircling wall that is open in a spraying direction of the paint spraying apparatus and forms a first part of the handle.

4. The paint spraying apparatus according to claim 1, wherein the front housing part also forms a second part of the handle, and together with the first part of the handle, defines a tubular form of the handle.

5. The paint spraying apparatus according to claim 4, wherein the housing further comprises an end cap, by way of which an end side of the handle at a free end thereof is closable.

6. The paint spraying apparatus according to claim 1, wherein the rear housing part closes the first receptacle space.

7. The paint spraying apparatus according to claim 1, wherein an open second housing portion of the rear housing part having a configuration including an annular base and an encircling wall forms the second receptacle space on the rear housing part, opposite to the first receptacle space, and wherein the encircling side wall of the second receptacle space is formed by a ring that is connected to the rear housing part.

8. The paint spraying apparatus according to claim 7, wherein the housing further comprises a housing lid that closes the second receptacle space, and wherein the housing lid encompasses the rear housing part into a region of the first receptacle space.

9. The paint spraying apparatus according to claim 1, wherein all directly neighboring housing parts in an assembled state are interconnected so as to be secured against rotation and/or displacement, such that the directly neighboring housing parts in the assembled state are integrally connected.

10. The paint spraying apparatus according to claim 9, wherein one of the front housing part forms a closable receptacle space for a battery pack.

11. The paint spraying apparatus according to claim 10, wherein two neighboring housing parts form the closable receptacle space for the battery pack.

12. The paint spraying apparatus according to claim 10, wherein contacts for establishing contact to the battery pack are disposed on one of the front housing part.

13. The paint spraying apparatus according to claim 12, wherein the contacts are disposed on two neighboring housing parts.

14. The paint spraying apparatus according to claim 12, wherein the contacts establish contact to a connector cable.

15. The paint spraying apparatus according to claim 9, wherein the directly neighboring housing parts in the assembled state have an interdisposed annular seal.

16. The paint spraying apparatus according to claim 1, further comprising a housing extension, wherein the housing extension is articulated on the handle so as to be pivotable or displaceable, wherein the handle is extended in an outwardly pivoted position, or in an outwardly displaced position, respectively, of the housing extension.

17. The paint spraying apparatus according to claim 1, wherein an adapter for connecting a spray head is formed by the housing, and wherein the adapter is formed by the central housing part.

18. The paint spraying apparatus according to claim 17, wherein the adaptor is formed by the front housing part.

* * * * *